US005261840A

United States Patent [19]

Benz

[11] Patent Number: 5,261,840

[45] Date of Patent: Nov. 16, 1993

[54] CONTACT ELEMENT AND PROCESS FOR THE PRODUCTION OF A CONTACT ELEMENT

[75] Inventor: Reinhard Benz, Basel, Switzerland

[73] Assignee: Sotax AG, Allschwil, Switzerland

[21] Appl. No.: 904,440

[22] Filed: Jun. 25, 1992

[30] Foreign Application Priority Data

Jun. 27, 1991 [CH] Switzerland ..... 1903/91

[51] Int. Cl.[5] ..... H01R 11/00

[52] U.S. Cl. ..... 439/843

[58] Field of Search ..... 439/816, 843, 851, 852, 439/858, 861, 862

[56] References Cited

U.S. PATENT DOCUMENTS

| | | | |
|---|---|---|---|
| 3,895,853 | 7/1975 | Neidecker . | |
| 4,013,329 | 3/1977 | Hugin . | |
| 4,039,235 | 8/1977 | Johnson, Jr. et al. | 439/843 |
| 4,080,033 | 3/1978 | Deal | 439/843 |
| 4,128,293 | 12/1978 | Paoli . | |

FOREIGN PATENT DOCUMENTS

| | | |
|---|---|---|
| 1665132 | 4/1967 | Fed. Rep. of Germany . |
| 2243034 | 9/1972 | Fed. Rep. of Germany . |
| 2634374 | 5/1977 | Fed. Rep. of Germany . |

*Primary Examiner*—Joseph H. McGlynn
*Attorney, Agent, or Firm*—Michael J. Striker

[57] ABSTRACT

The contact element has at least two parallel strips and a row of webs which are arranged between said strips, are of one piece with these and are twisted with respect to them and springy and have two constricted parts. Each web has two web edges, a first web edge having a convex part and the other, second web edge having a concave part, the convex part and concave part being located between the two constricted parts. When the webs are in the untwisted state, each convex part not arranged at the end of the web row projects into the concave part of the adjacent web. This enables the webs to compensate, by means of a spring travel, a large tolerance interval of the distance between two contact surfaces to be electrically conductively connected to one another by the contact element, the contact element simultaneously having a relatively large number of webs per length unit of the web row and being capable of being produced in an economical manner. A sheet metal is divided into the strips and the webs so that the sections of the sheet metal part which serve to form adjacent webs are separated from one another at least in the convex parts and concave parts by cutting processes without removal of material.

17 Claims, 4 Drawing Sheets

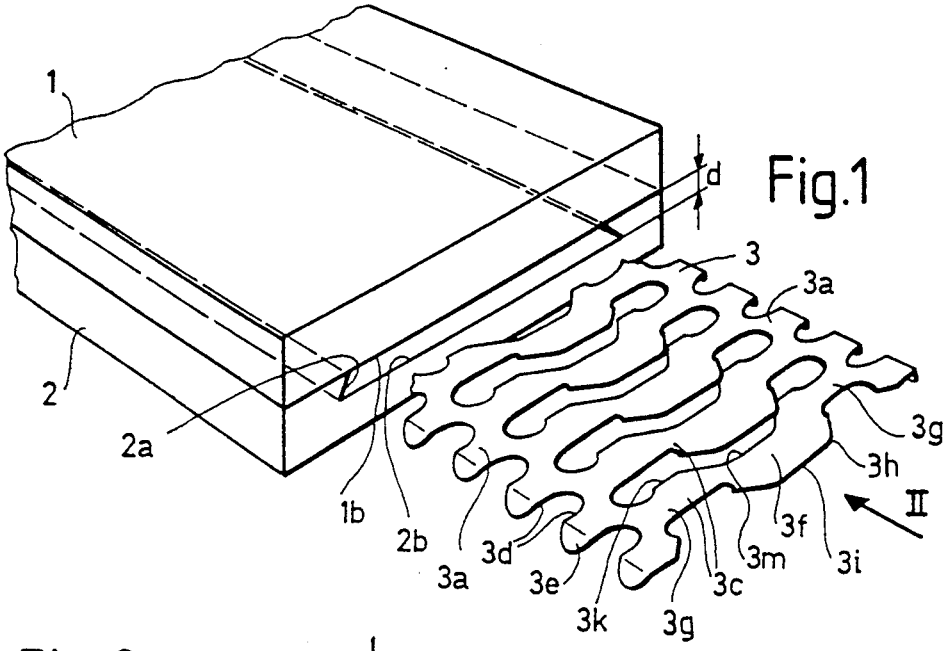
Fig.1
Fig.2
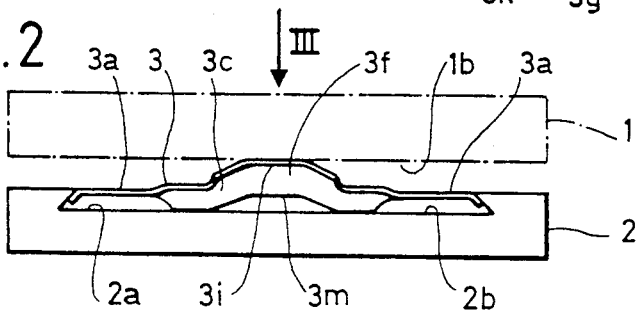
Fig.3
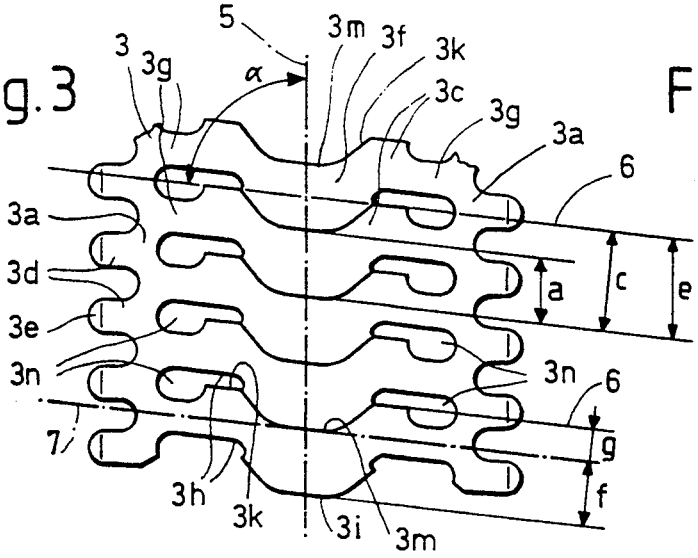
Fig.4
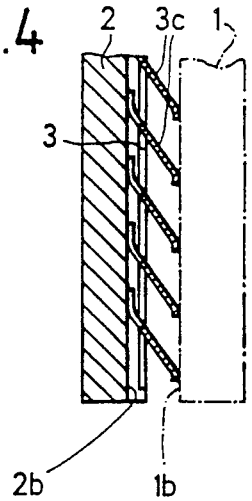

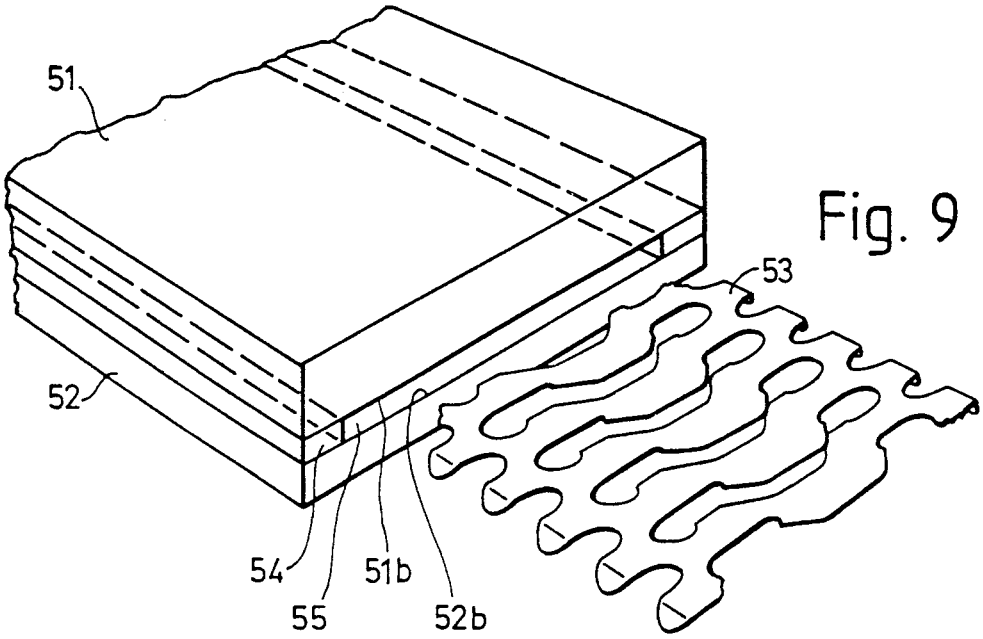
Fig. 9
Fig. 10
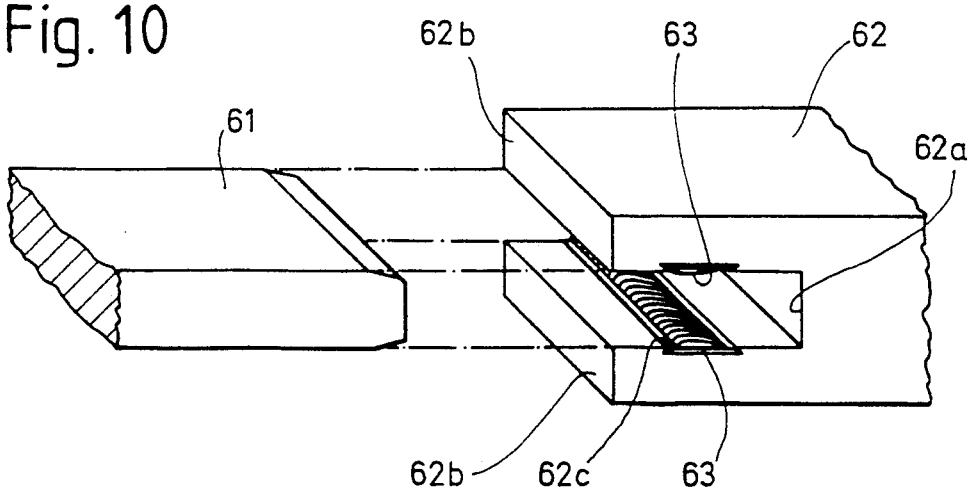

CONTACT ELEMENT AND PROCESS FOR THE PRODUCTION OF A CONTACT ELEMENT

BACKGROUND OF THE INVENTION

The invention relates to a contact element for arrangement between two base contact parts to be connected to one another with electrical conduction.

Such a contact element has at least two strips and a row of webs which are arranged between said strips, cohesive with these and twisted with respect to them and are springy and normally form elongated lamellae and which touch contact surfaces of the two base contact parts and can thus connect them conductively to one another, said contact surfaces facing one another and being a distance apart. Such contact elements can be used in particular for electrical connecting apparatuses in which relatively large currents, for example at least 20 A, are to be transmitted from one base contact part to another base contact part. The two base contact parts are normally separable from one another. The contact element is normally detachably held on one of the two base contact parts and, for example, frequently arranged in a groove inside the base contact part.

The distance between the contact surfaces to be connected to one another may vary within a certain range owing to manufacturing inaccuracies, especially in many connecting apparatuses—for example in connecting apparatuses serving as plug connectors or switches. The webs of a contact element should therefore be highly springy and in particular have a sufficient spring travel in order to be able to compensate the tolerance interval of the distance between the contact surfaces.

Various known contact elements consist of a piece of tape having two edge strips running along the tape edges and a row of twisted webs which are arranged between said edge strips and are cohesive with these and which form elongated lamellae, are at right angles to the edge strips and have a middle section which is connected to each of the two edge strips by a constricted part. In the known contact elements, the opposite edges of webs following one another along the web row are separated from one another over their entire length by slits, even when said webs are in the untwisted state. Furthermore, the contact elements are formed, for example, from sheet metal which consists of a copper-beryllium alloy strip, has been hardened by a heat treatment after shaping and has silvered surfaces.

For example, German Patent 1,665,132 discloses a contact element which has two parallel, straight edge strips and webs which are separated from one another by slits and whose two edges in the region of the middle section are arc-shaped and curved with mirror symmetry relative to one another. To ensure that the elongated webs of this known contact element have sufficient springiness, they must have a certain minimum width at right angles to their longitudinal directions. The minimum width is dependent on the distance between the opposite contact surfaces of the two base contact parts. Since slits are also present between the successive webs, the grid spacing, i.e. the distance, measured along the web row, between corresponding points of adjacent webs, is furthermore even greater than the stated minimum width of the webs. The known contact elements therefore have relatively few webs based on a length unit measured in the longitudinal direction of the web row, and permit only a correspondingly small current transmission per stated length unit.

To avoid this disadvantage, German Patent 2,243,034 envisages gathering the contact elements by making their edge strips wavy and/or meander-shaped, the edge strips preferably overlapping in certain sections. However, such a shaping of the edge strips requires additional tools and operations. Since the wavy or meander-shaped edge strips have very small radii of curvature or even folds, after hardening of the contact elements the edge strips are more likely to break during use of the contact elements. It is true that this danger of breakage can be reduced by making the edge strips flexible again after hardening by heat treatment. However, this requires additional operation which makes production of contact elements more expensive, so that such contact elements are substantially more expensive than contact elements having nonwavy edge strips. In addition, in the heat treatment which serves to make the edge strips flexible, it is virtually impossible to prevent hose sections of the webs close to the edge strips from partially losing their hardness and hence their spring effect, which is likewise disadvantageous.

Furthermore, the edge strips which are wavy or meander-shaped according to German Patent 2,243,034 have, in a longitudional section, a height which is substantially greater than the material thickness of the contact element. This may make it necessary for any grooves provided for holding the contact elements to be deeper than in the case of contact elements having smooth, nonwavy edge strips. Moreover, instead of swallowtail grooves frequently used for holding contact elements, it may be necessary to provide grooves of different shape.

SUMMARY OF THE INVENTION

It is the object of the invention to provide a contact element which eliminates the disadvantages of the known contact elements and, for example in the case of the envisaged spacing of the contact surfaces of base contact parts to be connected to one another with electrical conduction, may have a large number of webs, having a large spring travel, per length unit of the web row and is thus economical to produce and break-resistant in use.

This object is achieved according to the invention, by a contact element for arrangement between two base contact parts to be connected electrically conductively to one another, having at least two strips and a row of webs which are arranged between said strips, are of one piece with these and are twisted with respect to them and are springy and which have two web edges, a first web edge having a convex part, wherein the other, second web edge has a concave part and each convex part not at the end of the web row projects into the concave part of an adjacent web when the webs are in the untwisted state.

The invention furthermore relates to a process for the production of a contact element for arrangement between two base contact parts to be electrically conductively connected to one another, having at least two strips and a row of webs which are arranged between said strips, are of one piece with these and are twisted with respect to them and are springy and which have two web edges, a first web edge having a convex part and the other, second web edge having a concave part and each convex part not at the end of the web row projecting into the concave part of an adjacent part when the webs are in the untwisted state, and a sheet metal part being divided into the strips and the webs, wherein the sections of the sheet metal part which serve to form adjacent webs are separated from one another, at least in the convex parts and concave parts, by cutting processes without removal of material.

Advantageous embodiments of the contact element are described below.

The two base contact parts, for example together with at least one contact element, may belong to a connecting apparatus which serves for forming an electrical plug connector, where, for example, one base contact part may form a plug contact pin which has a quadrilateral—namely rectangular and flat—or circular cross-section and the other base contact part may form, for example, an even and/or fork-shaped or hollow cylindrical contact of a socket, which is intended for fastening to a fixed article of any kind or as a coupling socket for connection to a movable cable. The contact element may be fastened to the base contact part which belongs to the socket or to the base contact part which forms the plug pin. However, it is also possible for at least one contact element to be arranged between two busbars screwed to one another and/or detachably connected to one another in another manner, in which case the base contact parts are formed by these busbars and/or elements fastened thereto. It is also possible to provide a busbar which serves as a base contact part and onto which at least one other, for example fork-shaped, base contact part can be pushed in a detachable manner. Base contact parts of this type can be used, for example, for the formation of an electrical means having at least one immovably fastened busbar and displaceable inserts, each of which has at least one contact element which can be pushed onto the or a busbar. It is also possible to provide two immovably mounted busbars which are separated from one another by a gap-like intermediate space, are electrically conductively connected to one another and each form a base contact part and at least one base contact part which forms a flat pin which can be inserted between the two busbars. It is also possible to provide a connecting apparatus which is in the form of a switch and in which at least one contact element is fastened either to the fixed or to the movable base contact part of the switch.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 shows a perspective view of an electrical connecting apparatus having parts of two base contact parts and of a contact element pulled out therefrom, FIG. 2 shows a simplified view of the connecting apparatus in the viewing direction denoted in FIG. 1 by an arrow II, the upper base contact part being raised from the lower base contact part and being indicated only by dash-dot lines, FIG. 3 shows a plan view of the contact element in the viewing direction denoted in FIG. 2 by III, the webs, however, being drawn in the flat, untwisted state, FIG. 4 shows a simplified longitudinal section through the connecting apparatus, the base contact part located at the top in FIG. 2 being shown, analogously to that Figure, a distance away from the other base contact part and being indicated by dash-dot lines, FIG. 9 shows a perspective view, corresponding to FIG. 1, of a connecting apparatus having spacer bars arranged between the two base contact parts, FIG. 10 shows a perspective view of a connecting apparatus whose base contact parts form a flat contact, pin and a fork-shaped contact.

DESCRIPTION OF THE PREFERRED EMBODIMENTS

Figure 5:
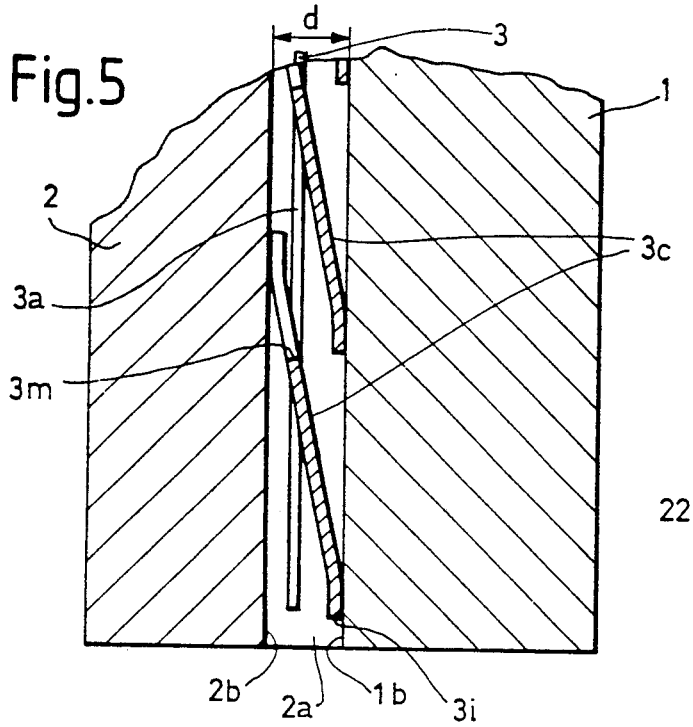
FIG. 5 shows a simplified longitudinal section which corresponds to FIG. 4 but has adjacent base contact parts and is on a larger scale.

The connecting apparatus shown in FIGS. 1, 2, 4 and 5 has two dimensionally stable, metallic, electrically conducting base contact parts 1 and 2 and a flexible and springy, likewise metallic, electrically conducting contact element 3.

One, first base contact part 1 forms an even, first contact surface 1*b* and the other, second base contact part 2 has a recess, namely a groove 2*a* which has a swallowtail-shaped cross-section and whose base forms an even, second contact surface 2*b*. The two base contact parts 1, 2 can, if desired, be held together according to FIGS. 1 and 5 by retaining and/or contact means which are not shown and can be connected to one another or separated from one another. If the two base contact parts 1, 2 are held together, the base contact part 1 rests with its even contact surface 1*b* against the base contact part 2 in such a way that the two contact surfaces 1*b*, 2*b* face one another and are parallel to one another and are a distance d apart, which is equal to the depth of the groove 2*a*. When the contact apparatus is in use, the contact element 3 is held in the groove 2*a* of the base contact part and is secured by retaining means which are not shown—for example by end plates or pins detachably fastened at the ends of the groove or by pinched end sections of the groove walls—and are thus prevented from sliding out of the groove.

The contact element 3, which is shown separately in FIG. 3, consists of a one-piece, tape-like part and has two edge strips 3*a* and a row of springy webs 3*c* which are arranged between said edge strips, are of one piece with these and are twisted with respect to them. The two edge strips 3*a* are generally straight and parallel to one another and have a nonwavy inner section which is at least flat in untwisted webs and, per web 3*c*, a projection 3*d* which projects from the inner section outward. If the contact element 3 is inserted into the groove 2*a*, its projections 3*d* engage the undercuts formed by the inclined, lateral limiting surfaces of the groove 2a. The free end sections 3e of the projections 3d, which sections are formed by the outermost sections of the two edge strips 3d, are bent relative to the remaining regions of the edge strips 3a in a cross-section that is at a right angle to the longitudinal direction of the web row, wherein the last mentioned regions lie in a plane when the contact element is relaxed. Said end sections 3e are namely inclined at least approximately parallel to the lateral limiting surfaces of the groove 2a toward the groove base forming the contact surface 2b. The outer edges of the two edge strips 3a are rounded, namely formed by hemispheres, at the free ends of the projections 3d and at the intermediate spaces present between the latter, so that the outer edges form a continuous wavy line when the edge strips are brought into a flat form and/or in the plan view shown in FIG. 3.

The webs 3c are elongated and each form a lamella. Each web has a middle section 3f and two constricted parts 3g which are arranged on opposite sides of the middle section and connect the latter to each of the edge strips. A first web, edge 3h of each web 3c forms a convex and/or projecting part 3i in the middle of the middle section 3f. The other, second web edge 3k of each web has a concave and/or recessed part 3m in the middle of the middle section 3f. The convex parts 3i have, for example, two straight flanks inclined from their root toward the middle and a summit which is approximately straight in the case of untwisted webs and in the plan view shown in FIG. 3, the two flanks being connected continuously to the summit by convex transitions. The concave parts 3m of the web edges 3k are complementary to the convex parts 3i of the web edges 3h and thus have in particular a base complementary to the summit of the convex part and flanks which approach one another towards said base. It should be noted that the entire flanks and/or the entire summits of the convex parts 3i may have a slight convex curve. Accordingly, the entire flanks and/or the entire bases of the concave parts 3m may have a concave curve. The convex parts and the concave parts of the web edges and those sections of the webs which are bounded by the convex parts and concave parts are thus almost trapezoidal and arc-shaped. In the plan view shown in FIG. 3, each web has approximately the shape of the crank of a crankshaft.

If, in accordance with FIG. 3, the webs are in the untwisted state and lie in a plane, each convex part 3i—with the exception of the convex part at the lower end of the web row in FIG. 3—projects into the concave parts 3m of the web directly adjacent to the relevant web 3c along the web row. In the middle sections 3f of the web 3c, the webs are separated from one another by incisions or cuts performed without removal of material, so that the web edges 3h, 3k of webs 3c directly adjacent along the web row at least approximately touch one another—when said webs are in the untwisted state—in the middle sections 3f in particular in the convex parts 3i and concave parts 3m.

The end sections of the adjacent webs, which sections form the constricted parts 3g, are separated from one another, in the untwisted state, by holes 3n whose edges form the end sections of the web edges 3h, 3k. Each hole 3n consists of an elongated hole or slot and has a broader section, for example at its end adjacent to an edge strip 3a, and a narrower section at its other end. The opposite longitudinal sections of the edges of the broader sections of two holes 3n following one another in succession along the web row together bound the narrowest section of a constricted part 3g. The edge of each hole 3n has, at the broader end of the hole, a curved, hemispherical end section. The longitudinal section of the hole edge, which section is adjacent to said end section and belongs to one of the first web edges 3h, extends in a straight line as far as the curved and/or angled end section of the hole edge, which is present at the narrower end of the hole. On the other hand, the longitudinal section of the hole edge, which section belongs to one of the second web edges 3k, is stepped and has two offset, straight sections parallel to the other longitudinal section of the hole edge. The inclined flanks of the convex parts 3i and of the concave parts 3m are, for example, directly adjacent to the edges of the holes 3n and thus to a certain extent join the holes 3n. Moreover, each hole 3n is arranged approximately in the same longitudinal region of the contact element as a projection 3d of the edge strip 3a located closer to the relevant hole 3n.

As already mentioned, the webs 3c are twisted and springy. The twisting is effected during production of the contact element, starting from an originally flat sheet metal part, especially by pressing the constricted parts 3g, which also serve as torsion springs and are responsible for a major proportion of the spring properties of the webs. The webs are twisted so that their middle regions are inclined toward a contact plane which touches the contact element and is parallel to the contact surfaces 1b, 2b, the angle of inclination in the relaxed contact element being 30° to 50° and, for example, about 40°. As can be seen from FIGS. 4 and 5, the summit regions of the convex parts 3i and the web edge regions located between the concave parts 3m and the constricted parts 3g are curved or possibly angled in a section along the web row in such a way that the webs rest against the contact surfaces 1b or 2b not only with projecting parts of the web edges (3h, 3k) but also with contact surface regions disposed adjacent and/or near the web edges.

The straight middle line 5 of the contact element, which line runs in the longitudinal direction of the entire contact element and of the web row, is also shown in FIG. 3. Furthermore, FIG. 3 shows contact lines 6, each of which touches a second web edge 3k at its contact points or contact parts projecting the furthest distance at right angles to the web and located on opposite sides of the concave part 3m of the relevant web, between the latter and one of the edge strips 3a. These contact points or parts are formed by the two sections of the second web edge 3k which are parallel to the contact lines 6, are located between the narrowest sections of the constricted parts 3g and the flanks of the concave parts and border the narrower sections of the holes 3n. It should also be mentioned that the contact lines 6 do not pass through the second web edges 3k at any point, apart from the penetration of the hole edge sections which delimit the holes 3n from the strips 3a and each of which connect a first web edge 3h and a second web edge 3k with one another. Each contact line 6 furthermore also runs through the mid-points of the broader sections of two holes 3n. FIG. 3 furthermore shows a central axis 7 of a constricted part, which axis is parallel to the contact lines 6 through the mid-points of the narrowest sections of two constricted parts 3g of a web 3c. The contact lines 6 and the central axes 7 of the constricted parts make, with the middle line 5 of the web row, an angle alpha which differs from 90°, and is preferably at least 80° and, for example, about 85°.

FIG. 3 also shows a first distance or a grid spacing a. This is understood as meaning the distance between corresponding points of two webs directly adjacent along the web row, measured parallel to the longitudinal direction of the web row and hence parallel to the middle line 5, so that the grid spacing a is in particular equal to the distance, measured in the stated direction, between the summits of directly adjacent convex parts 3*i* or between directly adjacent contact lines 6. Since the middle sections 3*f* of adjacent webs are separated from one another only by incisions, the dimension of a middle section of an untwisted web, measured parallel to the middle line 5, is approximately or exactly equal to the grid spacing a. c furthermore denotes a second distance, namely the distance from the summit of a convex part 3*i* to the contact line 6 touching the relevant web, this distance c being measured at right angles to the said contact line. FIG. 3 also shows the distance e, measured parallel to the middle line 5, from the summit of a convex part to the contact line 6 of the relevant web. Furthermore, f and g denote the third and fourth distances from the summit of a convex part 3*i* or from the contact line 6 of a web to the central axis 7 of its constriction, the distance of f and g being measured at right angles to the contact line 6 and to the central axis 7 of the constriction.

The distance c and the contact surface spacing d are matched with one another in such a way that the distance c is greater than the distance d and is namely, for example, about three times greater than the latter. The convex parts 3*i* and the concave parts 3*m* have dimensions such that the grid spacing a is preferably at least 30% and, for example, about 50% smaller than the distance c from the summit of a convex part to the contact line 6 of a web. Since the distance e is greater than the distance c by the reciprocal value of sine alpha, the ratio of a/e is accordingly somewhat smaller than the ratio a/c. The distance f from the summit of a convex part 3*i* to the central axis 7 of a constricted part is preferably at least 50% greater than the distance g from a contact line to the central axis 7 of a constricted part, f having, for example, approximately twice the magnitude of g.

If the contact element 3 is inserted into the groove 2*a* in the base contact part 2, and if the latter is a distance away from the base contact part 1, as in FIGS. 2 and 4, the convex parts 3*i* project out of the groove 2*a*, the contact element being substantially in the relaxed state. If, on the other hand, the base contact part 1 rests against the base contact part 2 as in FIG. 5, its contact surface 1*b* engages the convex parts 3*i* of the web 3*c* and presses said convex parts against the contact surface 2*b* formed by the groove base, with the result that the angle of inclination, by which the middle part of the webs is inclined with respect to the contact surfaces, becomes smaller. Each web 3*c* then rests, with a first contact region located at the summit of its convex part 3*i*, on the first contact surface 1*b* formed by the first base contact part 1. Furthermore, each web rests with two second contact regions against the second contact surface 2*b* formed by the second base contact part 2. The two second contact regions of a web 3*c* are formed by the sections of the second web edge 3*k* which are located between the narrowest points of the constricted parts 3*g* and the concave part 3*m*, are bordered along the narrow sections of the holes 3*n* and touch the contact line 6. The distance, measured at right angles to the contact lines 6 and the central axes 7 of the constricted parts, to the first contact region of a web is approximately equal to the distance c and namely—owing to the bending of the edge regions of the web which form the contact regions—slightly smaller than the distance c. The grid spacing a is therefore also smaller than the distance, measured in the stated manner, from the first contact region of the web to its second contact regions.

If the connecting apparatus having the contact element 3 is used, for example, as a plug connector or switch, it may be formed, for example, in such a way that the two base contact parts 1, 2 are pushed against one another at right angles to the longitudinal direction of the groove 2*a* during disconnection or making of an electrical connection, and that the contact element 3 held by the base contact part 2 slides along the contact surface 1*b* at right angles to the longitudinal direction of the web row. Owing to the angle alpha differing slightly from 90° and the bending of the edge regions of the webs 3*c*, which edge regions touch the contact surface, the sliding properties of the contact element on the contact surface 1*b* are improved and the production of scratches in the contact surfaces is reduced.

Furthermore, the described forms of the webs 3*c* and holes 3*n* ensure that the webs 3*c* touch the contact surfaces 1*b*, 2*b* only in the intended contact regions. If the contact element 3 slides along the first base contact part 1 during disconnection or making of an electrical connection, it is ensured in particular that the first web edges 3*h* have no corners which engage the contact edges 1*a* during the sliding processes, apart from their convex parts 3*i*.

The projections 3*d* of the edge strips 3*c* permit good anchoring of the contact element 3 in the groove 2*a* and considerable flexibility of the edge strips 3*c*. The rounded parts of the edge sections of the free ends of the projections 3*d* facilitate displacement of the contact element 3 during its introduction into the groove 2*a* and whenever it is required to pull the contact element 3 out of the groove 2*a*.

Furthermore, and in particular, the described embodiment and dimensions of the contact element ensure that the latter has a relatively small grid spacing a and hence relatively many webs 3*c* per length unit—based on the spacing d of the contact surfaces. The contact element accordingly permits high current transmission from one of the two base contact parts 1, 2 to the other base contact part. As already mentioned in the introduction, the distance d between the contact surfaces may vary within a certain tolerance interval. Since the grid spacing a is smaller than the distance c and accordingly c is greater than a, the webs are very springy in spite of the small grid spacing and compensate large tolerances of the distance d through a large spring travel.

The contact element 3 is formed, for example, from a sheet metal part which consists of a copper-beryllium alloy whose surfaces are provided with a coating of silver or of another electrically highly conductive and corrosion-resistant coating material.

Figure 6:
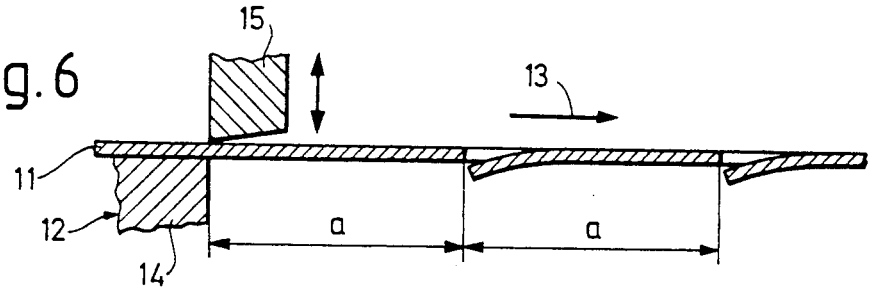
FIG. 6 shows a longitudinal section through parts of a tape-like workpiece, serving for the production of a contact element, and of cutting tools.

For the production of contact elements 3, a one-piece, tape-like sheet metal part 11 consisting of an unhardened copper-beryllium alloy and shown in FIG. 6 is processed synchronously and stepwise in a machine 12 indicated in FIG. 6. Said machine has transport means, which are not shown, in order to transport the tape-like and sheet-like part 11 stepwise in the transport direction parallel to its longitudinal direction and indicated by an arrow 13. The machine 12 furthermore has punch tools, which are not shown, for punching the projections 3*d* and the holes 3*n*, at least two cutting tools 14 and 15 for separating successive web middle sections 3*f* and shaping tools (not shown) for twisting the webs 3*c*, for bending their contact regions and for bending the free end sections 3*e* of the projections 3*d*. The fixed cutting tool 14 and the cutting tool 15 which can be moved up and down have a shearing edge whose shape corresponds to that of those parts of the web edges 3*h*, 3*k* which are located between a pair of holes 3*n*. If the machine has two or more pairs of tools 14, 15, the shearing edges of successive tools 14 are a distance apart corresponding to the grid spacing a along the sheet metal part 11.

The stated transport means transport the tape-like sheet metal part, during each transport step, by a distance which is equal to the grid spacing a or preferably equal to an integral multiple thereof. During each cycle, the punch tools punch a pair of holes 3*n*, preferably at the same time as several pairs of holes 3*n* in the sheet metal part. Furthermore, longitudinal regions of the outer edges of the edge strips 3*a* are punched in the same cycle or in a separate, preceding or following cycle. Thereafter, the sheet metal part 11 is transported to the cutting tools 14, 15. The pair or each pair of cutting tools 14, 15 then separates the sections of the sheet metal part 11 which subsequently form the middle sections 3*f* of adjacent webs 3*c* by means of a cut along a cutting line which extends from a hole 3*n* to the hole 3*n* coordinated therewith. Cutting is effected by means of a shearing process without material of the sheet metal part being removed between the two middle sections of the web. By means of these punching and cutting and/or shear processes, the sheet metal part 11 is divided into the edge strips 3*a* and webs 3*c*. In at least one cycle following the cutting and/or shear process, the envisaged shapes of the webs 3*c* and projections 3*d* are then produced by shaping. Thereafter, the sheet metal part can be cut into pieces with the length intended for the contact elements, hardened by a thermal treatment and silvered by electroplating or provided with coatings of another coating material. In this way, contact elements can be economically produced. It should be noted that the order of the operations described may be changed.

Figure 7:
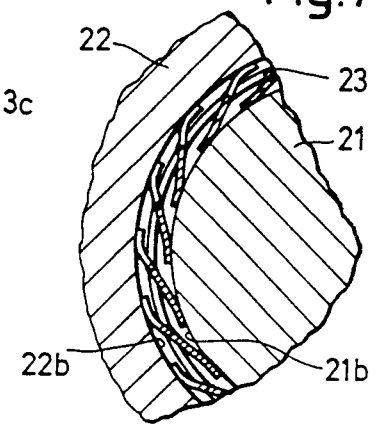
FIG. 7 shows a simplified section through a connecting apparatus whose base contact parts form a cylindrical pin and a socket.

The connecting apparatus shown in part in FIG. 7 and forming a plug connector has two base contact parts 21, 22 and a contact element 23. The base contact part 21 consists at least partly of a cylindrical pin which fits into the base contact part 22 forming a socket. One of the two base contact parts—namely, for example, the socket-like base contact part 22—is provided, on its surface facing the other base contact part, with an annular groove having a swallowtail cross-section. The outer surface of the base contact part 21 and the surface formed by the base of the annular groove of the base contact part 22 form coaxial, cylindrical contact surfaces 21*b* and 22*b*, respectively. The contact element 23 is similar to the contact element 3 and differs from the latter essentially only in that its edge strips are curved around the base contact part 21. Otherwise, the length of the contact element 23 is such that it at least virtually completely encloses the pin-like base contact part 21.

Figure 8:
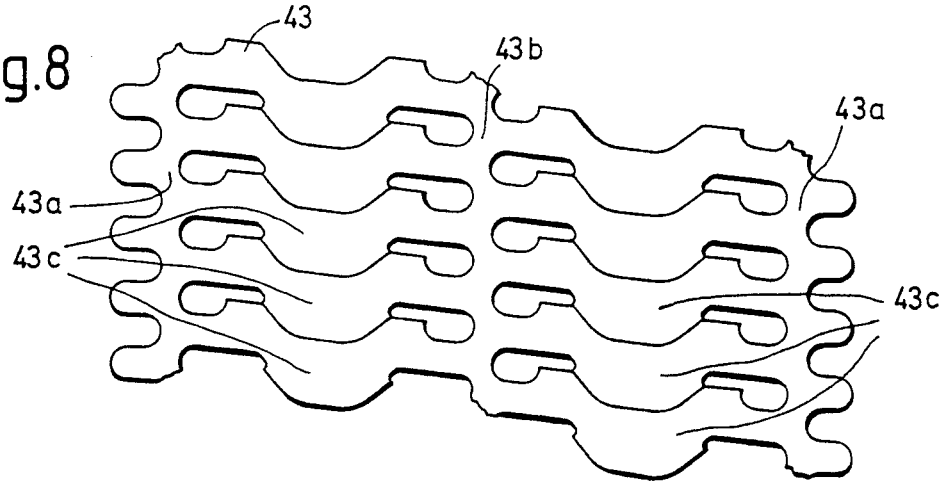
FIG. 8 shows a plan view, corresponding to FIG. 3, of a variant of a contact element having two rows of webs.

A one-piece contact element 43 shown in FIG. 8 has an inner strip 43*b* in addition to two edge strips 43*a*. Between said inner strip and each of the two edge strips 43*a*, is a row of webs 43*c*. The two edge strips and the webs are identical or similar to those in the contact element.

The connecting apparatus shown in FIG. 9 has two base contact parts 51, 51 having flat contact surfaces 51*b* and 52*b*, respectively. Spacer bars 54 which are rigidly and detachably or undetachably connected to at least one of two base contact parts 51, 52 and consist of metal or electrical insulating plastic are arranged between two base contact parts 51, 52. Between the two base contact parts there is then a cavity 55 which has, for example, a rectangular cross-section but could however, also have a swallowtail cross-section. Furthermore, the contact element 53 which, for example, is identical or similar to the contact element 3 is present. While the second base contact part 2 shown in FIGS. 1, 2, 4 and 5 has a groove 2*a*, in the connecting apparatus according to FIG. 9, for example, both base contact parts 51, 52 may consist completely of flat plates.

The connecting apparatus shown in FIG. 10 serves as the plug connector and has a first base contact part 61 which possesses a flat pin, i.e. a pin having a rectangular cross-section. The second base contact part 62 is in the form of a fork and has two prongs 62*b* separated from one another by a groove 62*a*. Its surfaces which face one another are each provided with a swallowtail groove 62*c*. Each groove 62*c* holds a contact element 63 which may be identical or similar to the contact element 3. The base contact part 61 has two contact surfaces facing away from one another, while the base contact part 62 has two contact surfaces which face one another and are formed by the base surfaces of the two grooves 62*c*.

Figure 11:
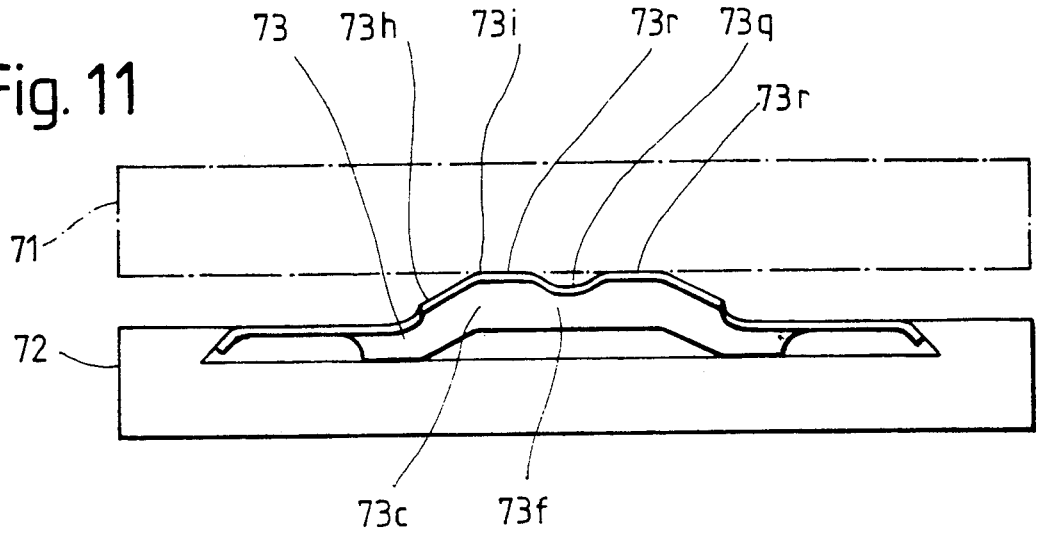
FIG. 11 shows a view corresponding to FIG. 2 of a variant of a contact element.
Figure 12:
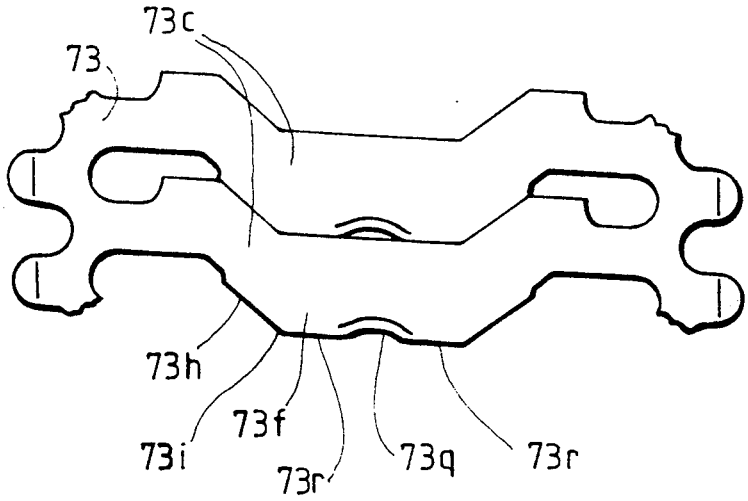
FIG. 12 shows a plan view of the contact element according to FIG. 11, wherein the webs of the contact element are drawn in flat, untwisted state analogously to FIG. 3.

The connecting apparatus shown in FIGS. 11 and 12 has two base contact parts 71 and 72 and an electrically conducting contact element 73. The parts 71, 72 are for instance similar to the contact parts 1 and 2, respectively. The contact element 73 is in general similar to the contact element 3 and comprises in particular a row of webs 73*c*. Each web 73*c* has a middle section 73*f* and a first web edge 73*h* that has a generally convex or projecting section 73*i* in the middle. The contact element 73 differs, however, from the contact element 3 by that the generally convex or projection section 73*i* of each first web edge 73*r* comprises a more or less deep, preferably only small concave web edge section or recess 73*q* in the middle of the first web edge 73*h*. This concave web edge section or recess 73*q* separates the generally convex or projection section 73*i* of each first web edge 73*r* in two convex sub-parts 73*r* each of which has a summit or sub-summit. The concave web edge section or recess 73*q* may for instance be produced by pressing a delve into an originally straight (or flat) summit portion of the generally convex or projecting section 73*i*. The remaining part of the contact element may for instance be similar as at the contact element 3.

The base contact parts and contact elements can also be modified in other ways. Reference is made here initially to the variants already mentioned in the introduction. Furthermore, the swallowtail groove of the base contact parts can, for example, be replaced by grooves having a rectangular cross-section. The projections corresponding to the projections 3*d* of the contact element can then, for example, be right angled or not bent at all. It would also be possible to omit the narrower sections of the holes 3*n* so that the web edges 3*h*, 3*k* could then have sections which are straight between the flanks of the convex parts 3*i* and the holes, are parallel to one another and are opposite one another virtually without any spacing in untwisted webs.

It will be understood that each of the elements described above, or two or more together, may also find a useful application in other types of methods constructions differing from the types described above.

While the invention has been illustrated and described as embodied in a contact element and process for the production of a contact element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A contact element for an arrangement between two base contact parts to be connected electrically conductively to one another, the contact element comprising at least two strips and a row of webs which are arranged between said strips and are of one piece with said strips, said webs being twisted with respect to said strips and being springy, said webs having two web edges including a first web wedge having a convex part and a second web edge having a concave part, each convex part of the first web edge of a web not at an end of a web row projecting into said concave part of the second web edge of an adjacent one of said webs when said webs are in an untwisted state, each of said second web edges having on both sides of said concave part between said concave part and the adjacent strip a projecting part, each of said webs defining a straight contact line which touches said projecting parts of the web, each of said convex parts having a summit, the straight contact lines defined by directly adjacent ones of said webs being spaced from each other by a first distance measured parallel to a longitudinal direction of said row of webs, said first distance being smaller than a second distance from said summit of said convex part to said straight contact line touching the relevant web and measured at a right angle to said straight contact line.

2. A contact element as defined in claim 1, wherein each of said convex parts has two flanks which approach one another toward said summit, each of said concave parts having a base and two flanks which approach one another toward said base.

3. A contact element as defined in claim 1, wherein said first distance is at least 30% smaller than said second distance.

4. A contact element as defined in claim 1, wherein said contact line makes with a longitudinal direction of said web row an angle which differs from 90°, said first distance being smaller than a distance measured from said summit to said straight contact line touching the relevant web and measured parallel to said longitudinal direction of said row of webs.

5. A contact element as defined in claim 1, wherein each of said webs has a middle section and two constricted parts which are arranged on opposite sides of said middle section and connect said middle section with said strips, each of said concave parts is located between said two constricted parts, a third distance from a summit of said convex part of one of said webs to an axis running through mid-points of a narrowest section of its constricted parts being at least 50% greater than a fourth distance from said axis to said contact line of the relevant web, said third and fourth distances being measured at right angles to said axis.

6. A contact element as defined in claim 1; and further having outer edge sections along a longitudinal direction of said web row, said outer edge sections being bent in a cross-section that is at a right angle to said longitudinal direction of said web row.

7. A contact element as defined in claim 1, wherein the webs directly adjacent to one another along said strips are separated from one another in a region of said convex parts and concave parts by cuts made without removal of material and at least approximately touch one another in the untwisted state, the webs directly adjacent to one another along said strips being separated by holes in untwisted state at both ends of said cuts.

8. A contact element as defined in claim 7, wherein each of said holes has a wider hole section adjacent to one of said strips and a narrower hole section further away from the relevant strip, each of said holes having a stepped edge section belonging to one of said second web edges, a part of one of said stepped edge sections that is adjacent to one of the narrower hole sections forming one of said projecting parts of one of the second web edges.

9. A contact element as defined in claim 1, wherein said strips form its outer edges running in a longitudinal direction of said web row and have for each of said webs an outward-pointing projection, said outer edges at free ends of said projections being rounded.

10. A contact element as defined in claim 9, wherein said outer edges also in intermediate spaces between successive projections are rounded.

11. A process for the production of a contact element for an arrangement between two base contact parts to be electrically conductively connected to one another, the process comprising the steps of providing at least two strips and a row of webs which are arranged between at least two strips and a row of webs which are arranged between the strips and being of one piece with the strips, twisting the webs with respect to the strips and making said webs springy and with two web edges including a first web edge having a convex part and a second web edge having a concave part such that each convex part of the first web edge of a web not at an end of the web row projects into the concave part of the second web edge of an adjacent web when the webs are in an untwisted state, each of said second web edges having on both sides of said convex part between said concave part and the adjacent strip a projecting part; dividing a sheet metal part so as to form the strips and the webs by making holes arranged to separate end sections of the directly adjacent webs and by making a cut without removal of material for separating a convex part of said first web edge of a web from said concave part of said second web edge of a directly adjacent web; and twisting said webs.

12. A contact element for an arrangement between two base contact parts to be electrically conductively connected to one another, the contact element comprising at least two strips and a row of webs which are arranged between said strips and are of one piece with said strips, said webs being twisted with respect to said strips and being springy, said webs having web edges including a first web having a convex part and a second web edge having a concave part, each convex part of said first web edge of a web not at an end of a web row projecting into said concave part of said second web edge of an adjacent one of said webs, when said webs are in an untwisted state, each of said second web edges having on both sides of said concave part between said concave part and the adjacent strip a projecting part, the webs directly adjacent to one another along said strips being separated from one another in a region of said convex parts and concave parts by cuts made without removal of material and at least approximately touching one another in the untwisted state, the webs directly adjacent to one another along said strips being separated by holes in untwisted state at both ends of said cuts.

13. A contact element as defined in claim 12, wherein each of said holes has a wider hole section adjacent to one of said strips and a narrower hole section further away from the relevant strip, each of said holes having a stepped edge section belonging to one of said second web edges, a part of one of said stepped edge sections that is adjacent to one of the narrower hole sections forming one of said projecting parts of one of the second web edges.

14. A contact element as defined in claim 13, wherein each of said webs defines a straight contact line that touches the two projecting parts of the second web edge of the relevant web, said contact line making with the longitudinal direction of said web row an angle which differs from 90°.

15. A contact element as defined in claim 14, wherein said angle is at least 80°.

16. A contact element for an arrangement between two base contact parts to be electrically conductively connected to one another, the contact element comprising at least two strips and a row of webs which are arranged between said strips and are of one piece with said strips, said webs being twisted with respect to said strips and being springy, said webs having two web edges including a first web edge having a convex part and a second web edge having a concave part, each convex part of said first web edge of a web not at an end of a web row projecting into said concave part of said second web edge of an adjacent one of said webs when said webs are in an untwisted state, said first web edge having a concave web edge section separating said convex part into two convex sub-parts, each of said second web edges having on both sides of said concave part between said concave part and the adjacent strip a projecting part, each of said web defining a straight contact line which touches said projecting parts of the relevant web, each of said convex parts having a summit, said contact lines defined by directly adjacent webs being spaced from each other by a first distance measured parallel to a longitudinal direction of the web row, said first distance being smaller than a second distance from said summits of said convex part to said contact line touching the relevant web and measured at a right angle to said contact line.

17. A contact element for an arrangement between two base contact parts to be electrically conductively connected to one another, the contact element comprising at least two strips and a row of webs which are arranged between said strips and are of one piece with said strips, said webs being twisted with respect to said strips and being springy, said webs having two web edges including a first web edge having a convex part and a second web edge having concave part, each convex part of said first web edge of a web not at an end of a web row projecting into said concave part of the second web edge of an adjacent one of said webs when said webs are in an untwisted state, each of said second web edges having at both sides between said concave part and the adjacent strip a projecting part.

* * * * *